US006039269A

United States Patent [19]

Mandzukic

[11] Patent Number: 6,039,269

[45] Date of Patent: Mar. 21, 2000

[54] COANDA EFFECT NOZZLE

[75] Inventor: Thomas Mandzukic, North Royalton, Ohio

[73] Assignee: Premier Farnell Corp., Cleveland, Ohio

[21] Appl. No.: 09/172,811

[22] Filed: Oct. 15, 1998

[51] Int. Cl.[7] ..... B05B 1/32

[52] U.S. Cl. ..... 239/458; 239/DIG. 7

[58] Field of Search ..... 239/DIG. 7, 456, 239/457, 458, 459, 460

[56] References Cited

U.S. PATENT DOCUMENTS

| | | | |
|---|---|---|---|
| 2,753,219 | 7/1956 | Matarese | 239/456 |
| 3,244,376 | 4/1966 | Thompson | 239/456 |
| 3,863,844 | 2/1975 | McMillan | 239/458 |
| 4,473,190 | 9/1984 | Gagliardo | 239/456 |
| 4,653,693 | 3/1987 | Steingass | 239/DIG. 7 |

*Primary Examiner*—Andres Kashnikow
*Assistant Examiner*—Davis Hwu
*Attorney, Agent, or Firm*—Jones, Day, Reavis & Pogue

[57] ABSTRACT

A water nozzle for use in vapor mitigation produces a wide conical water pattern by way of an outlet that has a coanda effect surface across which the water flows.

14 Claims, 3 Drawing Sheets

COANDA EFFECT NOZZLE

BACKGROUND OF THE INVENTION

This application relates to water nozzles and, more particularly, to water nozzles that produce a conical water pattern used in vapor mitigation. The invention is particularly applicable to a water nozzle that is convertible between a firefighting configuration and a vapor mitigation configuration, and will be described with specific reference thereto. However, it will be appreciated that the invention has broader aspects and can be used in other types of nozzles.

Water nozzles that produce a conical pattern commonly are used to mitigate the escape of hazardous and environmentally damaging gases or vapors by enveloping the gas or vapor within the cone of water. The water then carries the gas or vapor to a trench or other holding area for later treatment. The spread of the conical water pattern is limited in current water nozzle designs, and this means that a larger number of water nozzles must be used to cover a given area. It would be desirable to have a water nozzle that is capable of producing a larger conical water pattern than current nozzle designs.

SUMMARY OF THE INVENTION

A water nozzle for discharging a conical water pattern has an outlet with a coanda effect surface across which the water flows to enlarge the conical water pattern.

In accordance with one arrangement, the coanda effect surface is on a sleeve that is movable on the nozzle body parallel to the nozzle longitudinal axis. The sleeve is movable between one position in which water is discharged in a cylindrical pattern for firefighting purposes and another position in which water flows across the coanda effect surface in a conical pattern for vapor mitigation purposes.

In a preferred arrangement, the nozzle has a baffle or deflector that deflects a stream of water outwardly in a first conical pattern. The water in the first conical pattern then flows across the coanda effect surface for discharge in a second larger conical pattern.

It is a principal object of the invention to provide an improved water nozzle that uses the coanda effect to produce a very wide conical discharge pattern.

It is another object of the invention to provide an improved nozzle that is convertible between a firefighting mode for discharging a solid stream of water and a vapor mitigation mode for discharging a conical water pattern.

DESCRIPTION OF A PREFERRED EMBODIMENT

Figure 1:
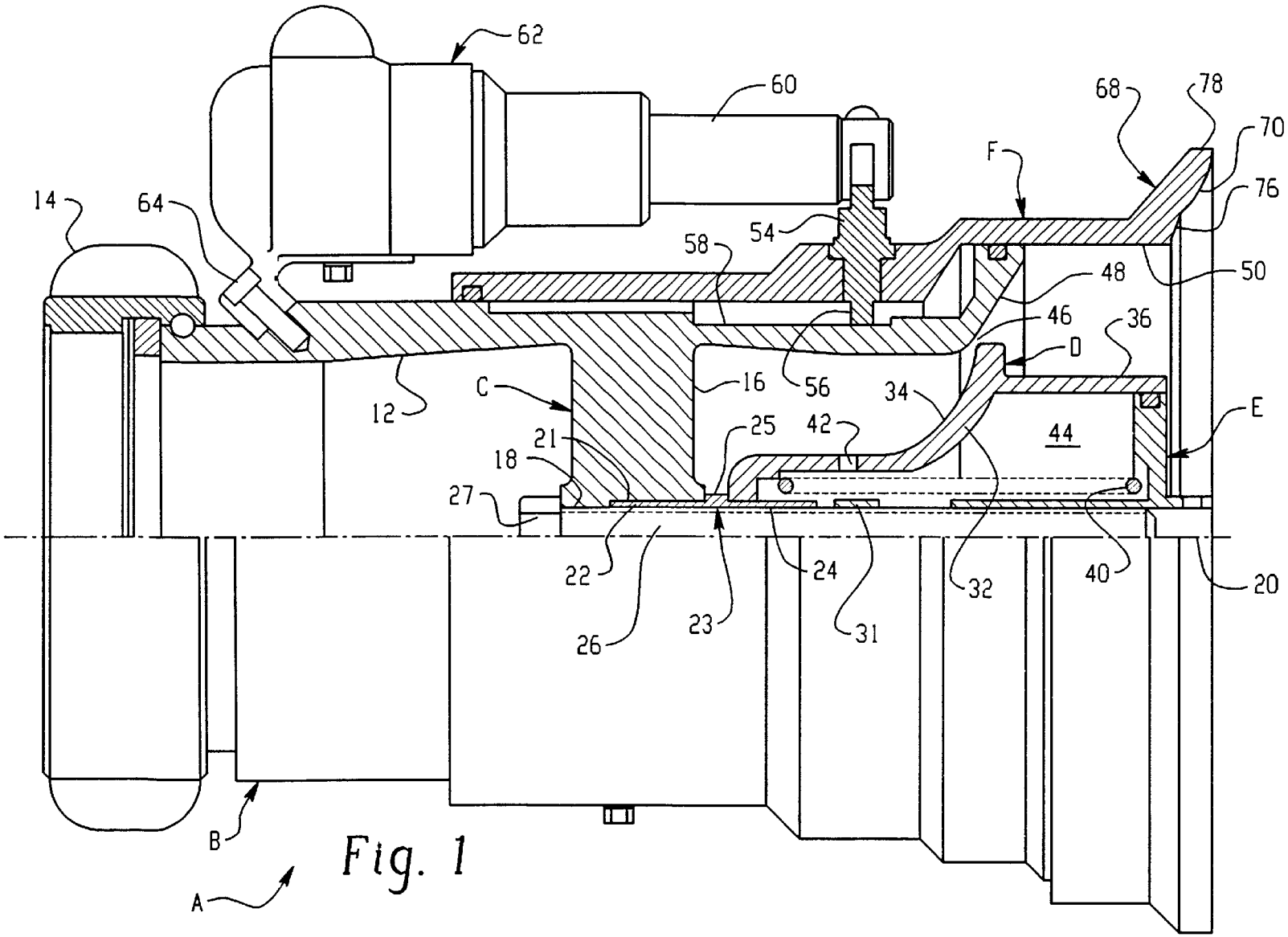
FIG. 1 is a partial cross-sectional elevational view of a water nozzle having the improvements of the present application incorporated therein, and with the nozzle configured for firefighting.
Figure 2:
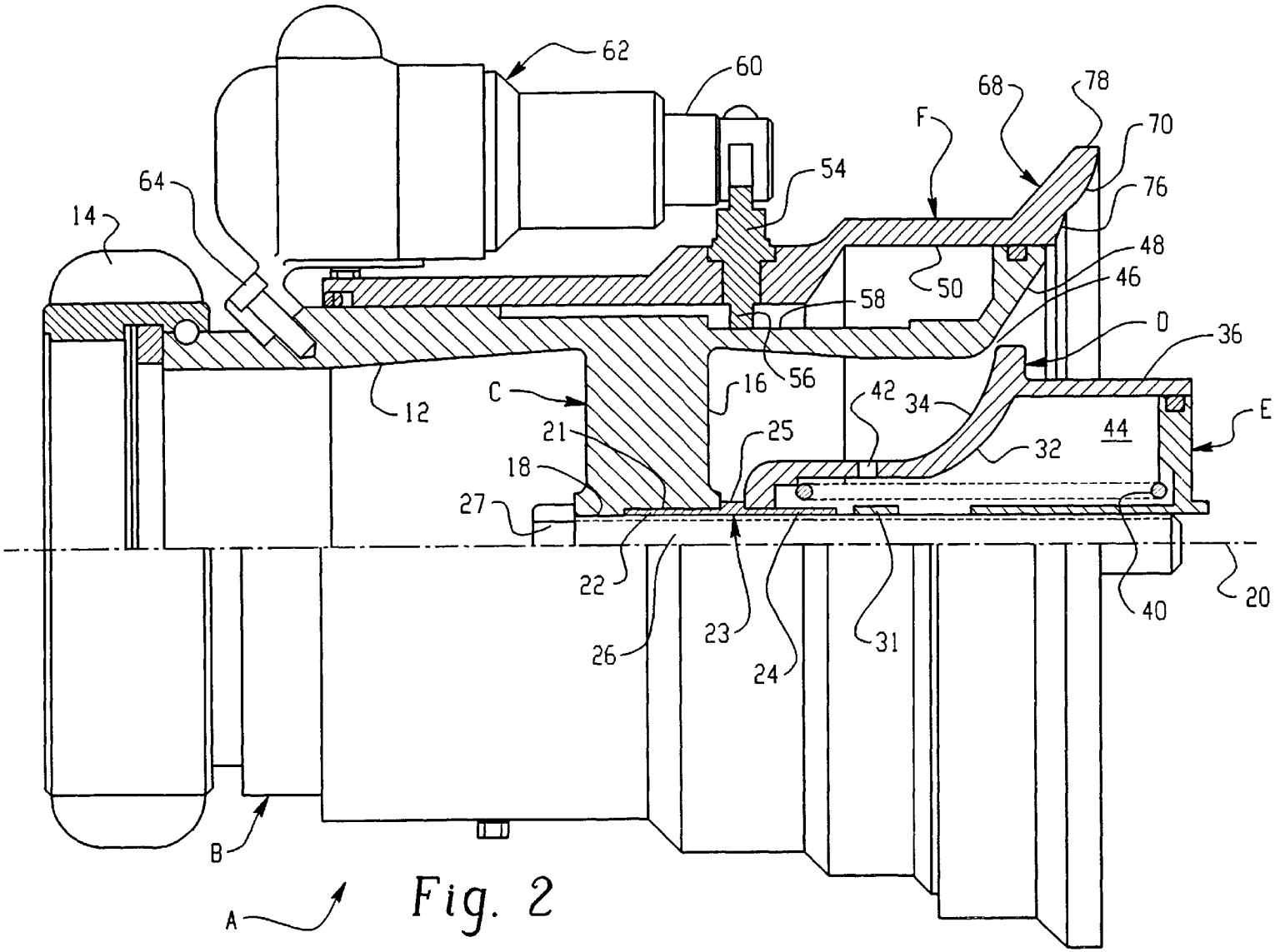
FIG. 2 is a partial cross-sectional elevational view similar to FIG. 1 and showing the water nozzle in a configuration for vapor mitigation.

Referring now to the drawing, wherein the showings are for purposes of illustrating a preferred embodiment of the invention only and not for purposes of limiting same, FIG. 1 shows a water nozzle A having a body B with a generally cylindrical internal passage 12 through which water flows from left-to-right. Nozzle body B has a swivel fitting 14 thereon at its inlet end for attachment to a pressurized water source.

The throat of nozzle passage 12 includes a spider C having a plurality of radially-extending circumferentially-spaced arms, only one of which is shown at 16. A cylindrical hole 18 in spider C is coincidental with nozzle longitudinal axis 20 and has a cylindrical recess 21 that receives a cylindrical centering sleeve 22 on an internally threaded collar 23. A cylindrical guide sleeve 24 on threaded collar 23 extends in an opposite direction from centering sleeve 22, and an enlarged central portion 25 has a hexagonal external shape for receiving a wrench. Both centering sleeve 22 and guide sleeve 24 are externally smooth.

An externally threaded rod 26 is threaded through collar 23 and receives a nut 27 on the opposite side of spider C from enlarged central portion 25 on collar 23. This secures the rod to the spider and locks the rod to the spider between nut 27 and central portion 25 on collar 23.

A generally bell-shaped baffle or deflector D has an end portion 30 slidably received on guide sleeve 24. A stop member 31 threaded on rod 26 is spaced slightly from the end of guide sleeve 24 and has a larger diameter than guide sleeve 24. End portion 30 on deflector D abuts stop member 31 to limit the movement of deflector D from left-to-right. Deflector D has an outwardly extending portion 32 that includes an outwardly curved outer deflector surface 34 that is smoothly curved. A cylindrical portion 36 on deflector D slides on a cap nut E that is threaded on rod 22. A coil spring 40 surrounding rod 26 bears against cap nut E at one end and against deflector D at the other end to normally bias deflector D to the left in FIG. 1 away from cap nut E.

At least one hole 42 in outwardly extending portion 32 of deflector D provides communication between nozzle body passage 12 and an interior chamber 44 that is defined between deflector D and cap nut E. This serves to equalize the pressure between chamber 44 and nozzle body passage 12. The pressure of water flowing through nozzle body passage 12 acts on deflector surface 34 to move deflector D to the right in FIG. 1 against the biasing force of coil spring 40. Variations in water pressure will vary the amount of movement of deflection D to adjust the size of an annular discharge slot 46 between the terminal end of outwardly extending curved discharge surface 34 on deflector D and a generally conical discharge surface 48 on nozzle body B.

In the configuration of FIG. 1, water flows through slit 46 along generally conical surface 48 against inner cylindrical surface 50 on a sleeve F for discharge in a cylindrical stream having significant reach for firefighting purposes. The included angle across generally conical surface 48 is limited to about 120°. That is, surface 48 shown in FIG. 1 makes an angle of about 60° with nozzle longitudinal axis 20. If the angle is increased, water discharged through annular slot 46 will be subjected to radical changes in flow direction resulting in energy losses and increased turbulence that significantly reduces the reach of the cylindrical stream for firefighting purposes in the configuration of FIG. 1.

Sleeve F is slidable on nozzle body B parallel to nozzle longitudinal axis 20. A pin 54 attached to sleeve F extends therethrough and includes a stop projection 56 received in a longitudinal slot 58 in nozzle body B. Pin 54 is attached to a rod 60 of a linear actuator 62 that is suitably attached to nozzle body B as generally indicated at 64. In the configuration of FIG. 1, rod 60 of actuator 62 is extended and sleeve F is in its extreme right most position so that nozzle A can be used in a firefighting mode by discharging a cylindrical stream that has significant reach.

Sleeve F has an outwardly extending annular projection 68 that includes a smoothly curved coanda effect surface 70 that faces both toward and parallel to nozzle longitudinal axis 20. Projection 68 has a circular sharp edge or corner 72 at the intersection with inner cylindrical surface 50. A short radially extending surface 74 extends from edge 72 to intersection with a straight inclined recessed surface 76 that intersects coanda effect surface 70. This configuration provides an annular recess or cavity 80 across which water flows from cylindrical discharge surface 48 on nozzle body B toward coanda effect surface 70. Thus, the recess creates a vacuum as the water flows therepast to draw the water toward the coanda effect surface. The sharp edge provides good separation of the water from recessed surface 76 so that the water flows past annular recess or cavity 80 toward coanda effect surface 70.

The coanda effect surface extends outwardly to intersect with outer cylindrical surface 78 at an angle of about 90° with nozzle longitudinal axis 20. Water flowing across conical discharge surface 48 at an angle of about 60° with nozzle longitudinal axis 20 adheres to coanda effect surface 70 and flows along the curved coanda effect surface before it is discharged or released therefrom at a much larger angle such as at least 65°.

Figure 3:
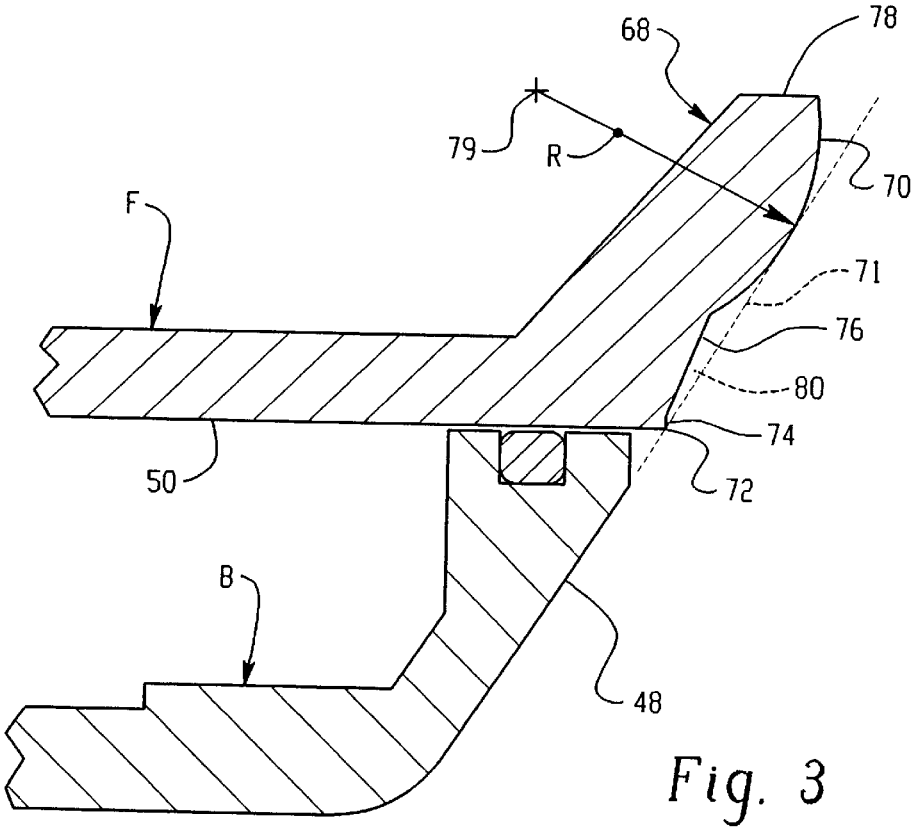
FIG. 3 is an enlarged partial cross-sectional view showing the relationship between a coanda effect surface and a conical surface that directs water toward the coanda effect surface.

The dotted line 71 in FIG. 3 represents a conical water pattern flowing from conical surface 48 toward coanda effect surface 70 generally tangent thereto. Edge 72 is aligned with conical surface 70, and a line extending from edge 72 tangent to coanda effect surface 70 is inclined at the same angle as conical surface 48. Coanda effect surface is positioned and curved so that water flowing from cylindrical surface 48 past edge 72 is generally tangent to coanda effect surface 70.

Strictly by way of example, and not by way of limitation, in a nozzle having a sleeve with a outer cylindrical surface on a diameter of about eight inches and inner cylindrical surface 50 on a diameter of about six inches, surface 70 is curved at a radius R of about three-fourths of an inch. The center of curvature 79 for radius R lies on a cylinder having the same diameter as outer cylindrical surface 78 on projection 68.

As is well known, the coanda effect is a phenomenon whereby a high velocity jet of liquid issuing from a narrow slot will adhere to a surface it is traversing and will follow the contour of the surface. Instead of simply flowing past surface 70, the water adheres to the surface and follows the curvature toward outer cylindrical surface 78. Therefore, the water is released or discharged from surface 70 in a generally conical pattern that has a larger included angle than the included angle of the conical water pattern that flows toward surface 70.

Figure 4:
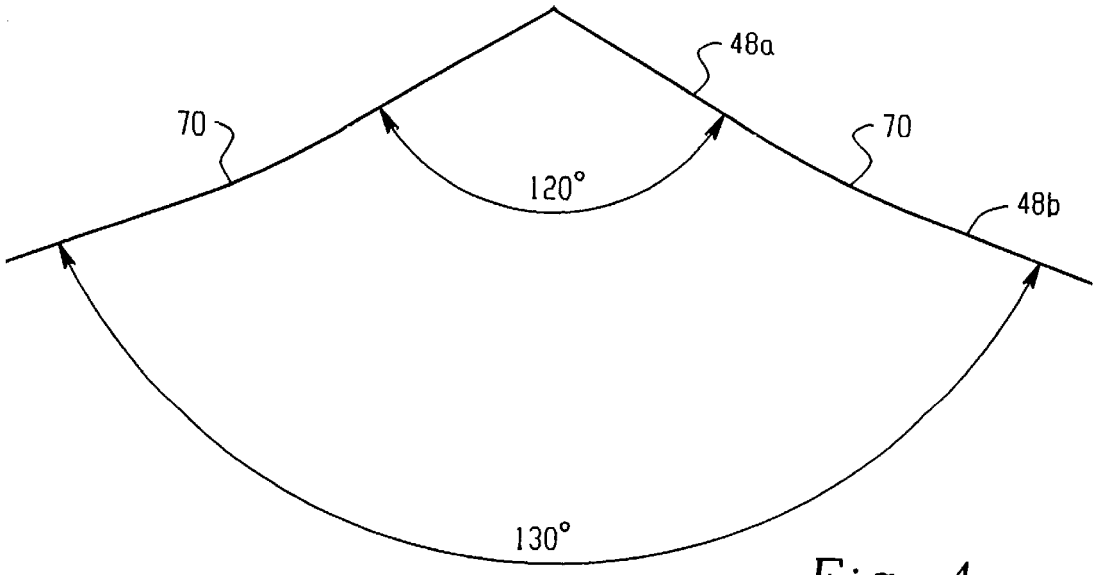
FIG. 4 is an illustration showing how a first conical pattern is enlarged by flowing across a coanda effect surface.

FIG. 4 shows water in a first conical pattern 48*a* having an included angle of about 120°. The water engages and flows across coanda effect surface 70 for discharge in a second conical pattern 48*b* that has a larger included angle such as 130°. Because the nozzles are positioned to provide an effective vapor mitigation barrier as wide as 100 feet, an increase of even five degrees in the included angle of the conical discharge pattern will significantly increase the effective width of the discharge pattern for vapor mitigation purposes.

Substantially all of the water discharged in the conical pattern is located in a relatively thin layer of water that can be considered a sheet of water although it is not a solid wall. However, there is very little water internally of the conical sheet as in many prior arrangements. With water droplets dispersed within the conical discharge, there are more voids through which hazardous gas or vapor can escape. The arrangement of the present application discharges a conical pattern that has a very high water density because water droplets are not widely dispersed and there are few voids through which hazardous gas or vapor can escape.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

I claim:

1. A nozzle for producing a substantially hollow conical water pattern, said nozzle having a longitudinal axis and an outlet, a conically inclined surface surrounding said outlet and extending outwardly therefrom, a convexly curved coanda effect surface surrounding said conically inclined surface in outwardly-spaced relationship thereto a deflector positioned adjacent said outlet and forming an annular slot therewith through which water is deflected outwardly of said axis along said conically inclined surface as a sheet-like layer in a first hollow conical pattern having a first included angle, an annular cavity between said coanda effect surface and said conically inclined surface, said coanda effect surface being positioned for flow of water in said first hollow conical pattern past said cavity into tangential engagement with said coanda effect surface, said cavity providing a vacuum as water in said first hollow conical pattern flows therepast to draw the water in said first hollow conical pattern against said coanda effect surface, and said coanda effect surface providing outward expansion of all of the water in said first hollow conical pattern into an outwardly expanded sheet-like thin layer in a second hollow conical pattern having a second included angle that is greater than said first included angle.

2. The nozzle of claim 1 wherein said nozzle includes a nozzle body and a sleeve movable on said nozzle body in a direction parallel to said nozzle longitudinal axis, said coanda effect surface being on said sleeve, said sleeve being movable between one position in which said coanda effect surface is positioned to provide flow of water from said conically inclined surface across said coanda effect surface and a second position wherein said sleeve is positioned to convert said first conical pattern into a cylindrical stream that does not flow across said coanda effect surface, and said sleeve and said coanda effect surface being one integral piece.

3. The nozzle of claim 2 including an annular sharp edge on said sleeve between said cavity and said conically inclined surface, and said annular sharp edge being positioned for flow of water in said first hollow conical pattern across said annular sharp edge and past said cavity into tangential engagement with said coanda effect surface in said one position of said sleeve.

4. The nozzle of claim 1 wherein said coanda effect surface has a circular curvature on a radius that is centered on a cylinder that intersects said curvature at a location where said curvature is 90° to said nozzle longitudinal axis.

5. The nozzle of claim 1 wherein said deflector is pressure compensated to automatically vary the size of said annular slot in accordance with the water pressure within said nozzle.

6. The nozzle of claim 1 including an annular sharp edge between said cavity and said conically inclined surface, said annular sharp edge being spaced outwardly from said conically inclined surface, and said annular sharp edge being positioned for flow of water in said first hollow conical pattern across said annular sharp edge and past said cavity into tangential engagement with said coanda effect surface.

7. The nozzle of claim 1 wherein said coanda effect surface has an outer termination, and said coanda effect surface being configured to provide release of water therefrom in said second hollow conical pattern before the water reaches said outer termination.

8. The nozzle of claim 7 wherein said coanda effect surface is curved to extend 90° to said longitudinal axis of said nozzle at said outer termination thereof.

9. A nozzle having a longitudinal axis, a conically inclined surface extending outwardly from said axis, a deflector that deflects water along said conically inclined surface as a sheet-like layer in a first hollow conical pattern having a first included angle, a circumferentially continuous coanda effect surface surrounding said conically inclined surface in outwardly-spaced relationship thereto and positioned to tangentially receive all of the water in said first hollow conical pattern at a first distance outwardly from said axis and to release all of the water in said first hollow conical pattern at a second distance outwardly from said axis that is greater than said first distance as an outwardly expanded sheet-like thin layer in a second hollow conical pattern having a second included angle that is greater than said first included angle.

10. The nozzle of claim 9 wherein said nozzle includes a nozzle body and said coanda effect surface is on a sleeve that is movable on said body in a direction parallel to said axis between one position in which water flowing through said nozzle body exits through said outlet in a cylindrical stream without engaging said coanda effect surface and another position in which water flowing through said nozzle body engages said coanda effect surface and is discharged in said second conical pattern.

11. A nozzle having a nozzle body with a longitudinal axis, an outwardly extending conically inclined surface and a deflector that deflects water outwardly of said axis alone said conically inclined surface as a sheet-like layer in a generally conical hollow flow pattern, a sleeve slidable on said nozzle body between extended and retracted positions, said sleeve in said extended position thereof having a cylindrical inner surface that intercepts said generally conical hollow flow pattern of water and converts same into a cylindrical discharge stream, said sleeve in said retracted position thereof having a peripherally continuous coanda effect surface that surrounds said conically inclined surface in outwardly-spaced relationship thereto and tangentially intercepts all of the water in said generally conical hollow flow pattern of water from said conically inclined surface and converts all of same into an outwardly expanded sheet-like thin layer in a generally conical hollow discharge pattern having a larger included angle than said conical flow pattern.

12. The nozzle of claim 11 wherein said conical flow pattern has an included angle that is not greater than 120°.

13. The nozzle of claim 11 wherein said coanda effect surface curves outwardly to an included angle with said longitudinal axis of at least 75°.

14. The nozzle of claim 13 wherein said included angle is 90°.

* * * * *

UNITED STATES PATENT AND TRADEMARK OFFICE

CERTIFICATE OF CORRECTION

PATENT NO. : 6,039,269

DATED : March 21, 2000

INVENTOR(S) : Thomas Mandzukic

It is certified that error appears in the above-identified patent and that said Letters Patent is hereby corrected as shown below:

Column 6, Line 8 (Line 3 of Claim 11), "alone" should be ---along---.

Signed and Sealed this

Twenty-fourth Day of October, 2000

*Attest:*

*Attesting Officer*

Q. TODD DICKINSON

*Director of Patents and Trademarks*